United States Patent [19]

Theurer

[11] Patent Number: 4,534,689

[45] **Date of Patent: * Aug. 13, 1985**

[54] MOBILE RAIL CONTOURING MACHINE

[75] Inventor: Josef Theurer, Vienna, Austria

[73] Assignee: Franz Plasser Bahnbaumasch Inenindustriegesellschaft m.b.H., Vienna, Austria

[ * ] Notice: The portion of the term of this patent subsequent to Dec. 28, 1999 has been disclaimed.

[21] Appl. No.: 462,526

[22] Filed: Jan. 31, 1983

Related U.S. Application Data

[63] Continuation of Ser. No. 141,892, Apr. 21, 1980, abandoned.

[30] Foreign Application Priority Data

Aug. 14, 1979 [AT] Austria ..... 5538/79

[51] Int. Cl.[3] ..... B23D 1/20; E01B 31/15

[52] U.S. Cl. ..... 409/296; 51/178; 409/178; 409/339

[58] Field of Search ..... 409/337, 338, 296, 298, 409/339, 178, 180; 144/133 B; 51/178

[56] References Cited

U.S. PATENT DOCUMENTS

| | | | |
|---|---|---|---|
| 1,025,754 | 5/1912 | Little | 409/337 |
| 1,032,721 | 7/1912 | Woods et al. | 29/402.19 X |
| 1,216,097 | 2/1917 | Eunson | 409/180 |
| 1,759,325 | 5/1930 | Schmidt | 51/178 X |
| 1,988,138 | 1/1935 | Peck | 51/178 |
| 3,823,455 | 7/1974 | McIlrath et al. | 51/178 X |
| 4,050,196 | 9/1977 | Theurer | 51/178 |
| 4,365,918 | 12/1982 | Theurer | 409/296 |

*Primary Examiner*—Z. R. Bilinsky
*Attorney, Agent, or Firm*—Kurt Kelman

[57] ABSTRACT

A mobile rail contouring machine is arranged for continuously removing such running surface irregularities as ripples, corrugations and overflow metal from rail heads during the continuous movement of the machine along a railroad track. The machine comprises a frame, a rail contouring tool mounting linked to the frame, and a drive for adjusting the mounting vertically relative to the running surface of the rail head and for pressing the mounting thereagainst and laterally without play against the rail head side which is not worked. A plurality of guide rollers engage the running surface of the rail head and vertically guide the mounting therealong and an additional guide roller laterally guides the mounting without play along the rail head side. A rail contouring tool head including a tool holder is mounted on the mounting between two of the guide rollers and a rail contouring tool is mounted in the tool holder.

19 Claims, 8 Drawing Figures

FIG. 4
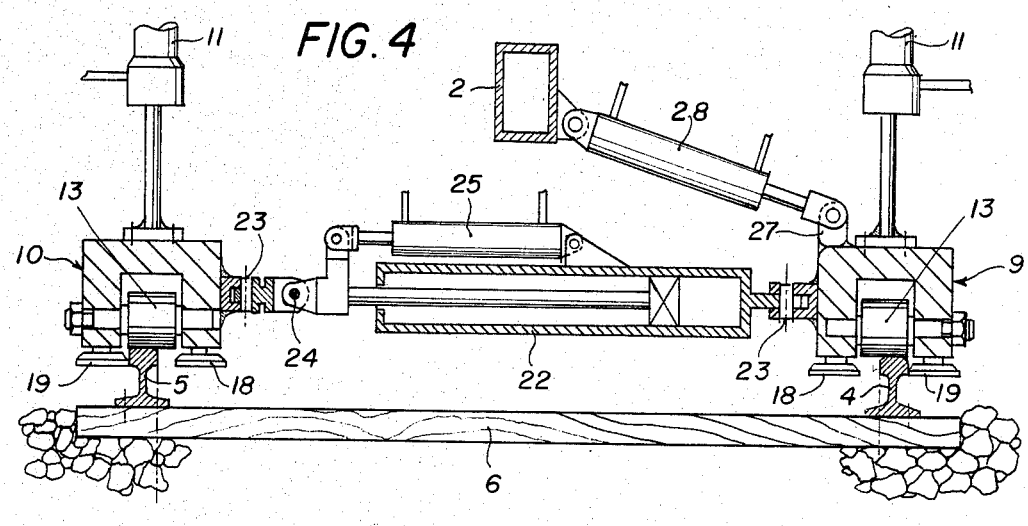
Fig. 5
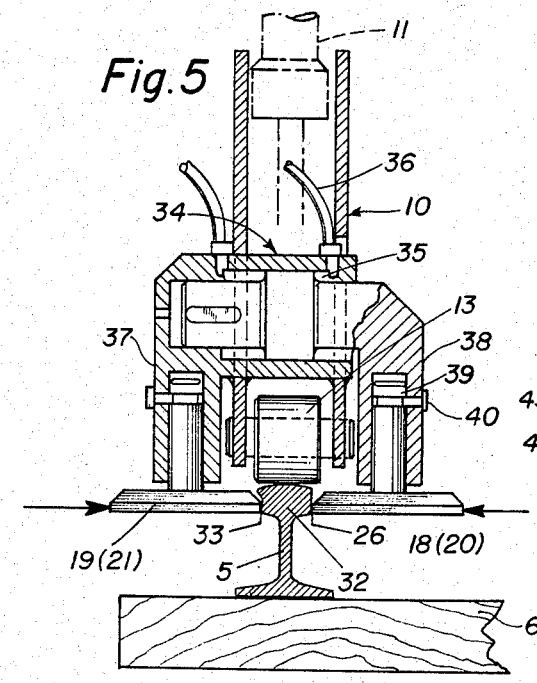
Fig. 6
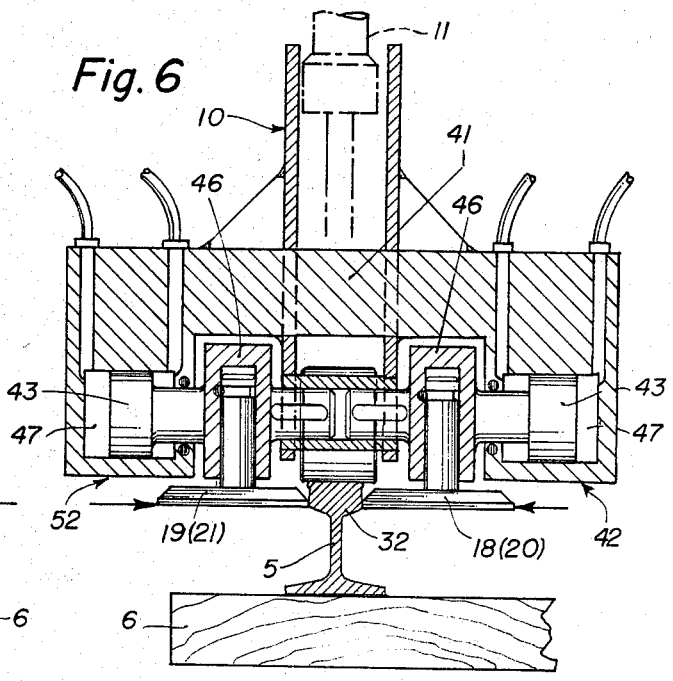
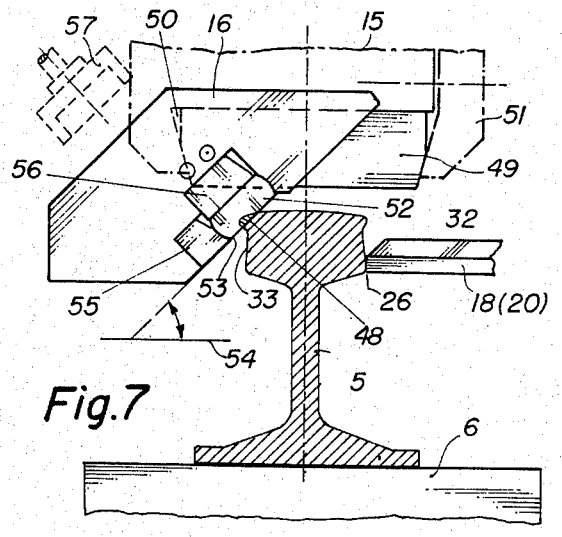
Fig. 7
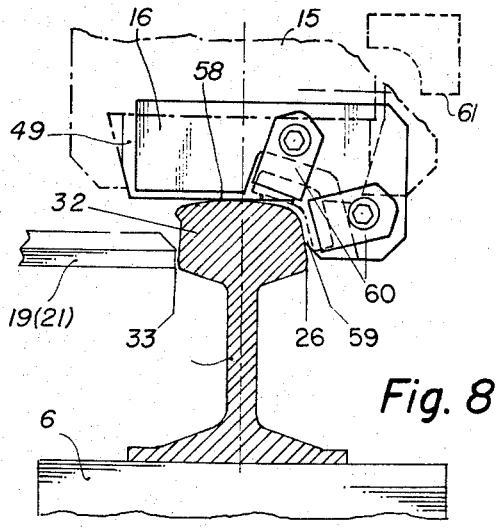
Fig. 8

MOBILE RAIL CONTOURING MACHINE

This application is a continuation of application Ser. No. 141,892, filed 04/21/80 now abandoned.

The present invention relates to a mobile rail contouring machine mounted on a railroad track for continuous movement in an operating direction, the track including two rails each having a rail head defining a gage side, a field side and a running surface, and the machine being arranged for continuously removing such running surface irregularities as ripples, corrugations and overflow metal during the continuous movement.

Known machines of this type comprise a frame, a rail contouring tool mounting linked to the frame, drive means for vertically adjusting the mounting relative to the running surface of the rail head of a respective rail and for pressing the mounting thereagainst, the mounting being guided vertically and laterally along the sides and the running surface of the rail head, a rail contouring tool head including a tool holder arranged on the mounting and a rail contouring tool mounted on the tool holder. The rail contouring tool may be a rotary grinding disc or a whetstone and, where it was desired to remove the irregularities to a greater depth, a planing tool including a cutting blade.

U.S. Pat. No. 2,779,141, dated Jan. 29, 1957, discloses a mobile rail grinder wherein two mountings are arranged between the undercarriages of a mobile machine and are guided along the track rails by flanged wheels. Each mounting carries three independent grinding devices independently vertically adjustable with respect to the mounting, each grinding device having a vertical rotary shaft and a grinding disc at the lower end of the shaft. The pressure of each grinding disc against the rail is controlled by a complex and multi-part control and the amount of metal ground off during each pass of the machine is so small that numerous passes are required to obtain a noticeable grinding result, requiring long periods of time closing the track to passenger or freight traffic. Therefore, it has been proposed to couple a number of such rail grinders together to form a train so as to reduce the number of grinding passes. Such rail grinding trains are expensive, require considerable operating personnel and substantial maintenance and organizational efforts for planning the work and controlling the traffic interrupted thereby. The construction and maintenance of the proper controls for guiding and operating the mountings and the grinding discs are also extensive.

U.S. Pat. No. 4,050,196, dated Sept. 27, 1977, improves on this type of mobile rail grinder by associating shaping tools with the rotary grinding discs for profiling the grinding surfaces of the discs. This machine comprises a mounting linked to the frame, vertically adjustable in relation thereto and guided along the two track rails by flanged wheels, a tool head being vertically and laterally displaceably arranged in the mounting for centering the grinding disc carried by the tool head with respect to the associated rail. This improves the accuracy of the grinding operation and the adjustment of the grinding discs. However, since the vertically adjustable tool heads must be adapted closely to the profile of the rail head, due to the presence of the shaping tools, there is little room for adapting to different profiles and irregularities. Furthermore, the adjustable mountings and tool heads are relatively complicated.

German Pat. No. 905,984, published Mar. 8, 1954, discloses a vise clamped to a rail at a rail joint and carrying a mechanism including a tool head mounting a tool for milling the welded joint. The tool head is cranked back and forth along the running surface of the rail head to plane the joint. This devise is only useful locally at respective rail joints and cannot be used for the continuous contouring of a rail. It is also complex in construction and use.

U.S. patent application Ser. No. 879,956, filed Feb. 21, 1978, now U.S. Pat. No. 4,249,346, granted Feb. 10, 1981, discloses a mobile rail grinding machine wherein two groups of whetstones are mounted on two carriages guided along the rails by flanged wheels. A common mechanism reciprocates the two carriages to superimpose working motion to the whetstones in addition to the continuous motion exerted by the advancement of the machine. This considerably increased the efficiency compared to prior machines working with whetstones and grinding discs but it still did not produce desirable depths of metal removal, particularly with high accuracy, which is important for attaining operational economy.

U.S. patent application Ser. No. 968,264, filed Dec. 11, 1978, now U.S. Pat. No. 4,295,764, granted Oct. 20, 1981, discloses a mobile rail contouring machine with a plurality of mountings vertically adjustably connected to the machine frame and vertically and laterally guided along the rail, each mounting carrying a number of cutting blades or whetstones. The mounting with the cutting blades affixed thereto is vertically adjustable relative to the flanged wheels supporting it on the rail so as to position the cutting blades in relation to the running surface of the rail head for milling it. The mountings associated with each rail are linked together by a hydraulic cylinder-piston unit for spreading the mountings and blocking them in position. This arrangement made it possible for the first time to obtain the continuous removal for irregularities from the running surface of the rail head with cutting or planing tools at high efficiency but it was not always possible to achieve accurate contouring to the desired profile. In addition, centering of the contouring tools and setting them properly in relation to the surface to be milled was often difficult.

It is the primary object of this invention to provide a mobile rail contouring machine for continuously removing such running surface irregularities as ripples, corrugations and overflow metal during the continuous movement of the machine along a railroad truck, which more exactly guides the rail contouring tool mounting with its tool head along the rail on which the tool works.

The above and other objects are accomplished according to the invention with a mobile rail contouring machine comprising a frame, a rail contouring tool mounting linked to the frame, and drive means for adjusting the mounting vertically relative to the running surface of the rail head of one of the rails and for pressing the mounting thereagainst and laterally without play against a selected one of the rail head sides of the one rail. Guide roller means guides the mounting vertically and laterally along the rail head and includes a plurality of guide rollers for engaging the running surface of the rail head and for vertically guiding the mounting therealong, the guide rollers being spaced along the mounting in the operating direction, and an additional guide roller laterally guiding the mounting without play along a selected one of the sides of the rail head. A rail contouring tool head including a tool holder is mounted on the mounting between two of the guide rollers and a rail contouring tool is mounted in the tool holder.

Such a guide roller means enables the mounting to be guided accurately along the side of the rail head which is not worn, whether this is the gage or field side of the rail head, so that the mounting with the tool head will constantly be guided in an exactly determined position in relation to the work during the continuous movement of the machine along the track. This will provide a precise and true reference for the rail contouring work since the mounting will be laterally guided along the substantially perfect side of the rail head, preferably the lowermost region thereof, independently of the vertical guidance of the mounting, thus establishing a substantially parallel guidance along the track.

The above and other objects, advantages and features of the present invention will become more apparent from the following description of certain now preferred embodiments thereof, taken in conjunction with the accompanying drawing wherein FIG. 1 is a schematic side elevational view of a mobile rail contouring machine for continuously removing surface irregularities from the rails of a railroad track;

FIGS. 4, 5 and 6 are transverse sections showing further embodiments;

FIGS. 7 and 8 are enlarged transverse sections along lines VII—VII and VIII—VIII, respectively, showing the rail contouring tool at one of the rails.

Figure 1:
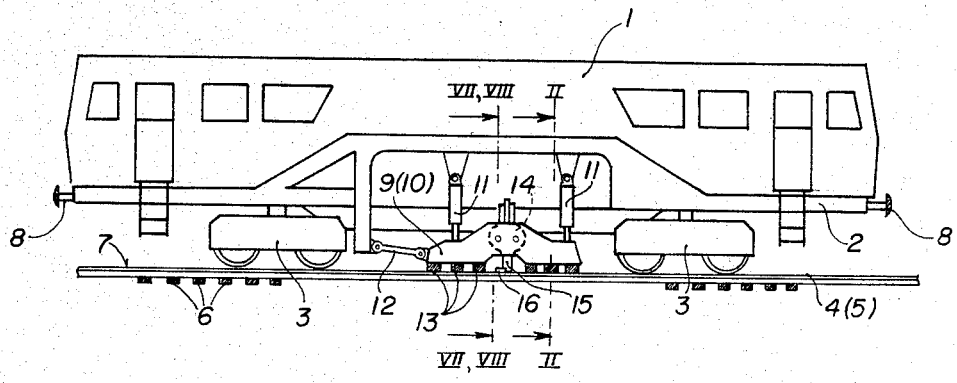

Referring now to the drawing and first to FIG. 1, there is shown mobile rail contouring machine 1 mounted on railroad track 7 for continuous movement in an operating direction. The track includes ties 6 to which are fastened two rails 4 and 5 each having rail head 32 (see FIGS. 7 and 8) defining gage side 26, field side 33 and a running surface. The machine is arranged for continuously removing such running surface irregularities as ripples, undulations or corrugations and overflow metal 48 during the continuous movement in the operating direction.

Rail contouring machine 1 comprises frame 2, rail contouring tool mounting 9, 10 linked to the frame, a respective mounting being associated with a respective rail, and drive means 11 for adjusting the mounting vertically relative to the running surface of the rail head of the associated rail and for pressing the mounting thereagainst. As more fully described hereinafter, it also has drive means 25 for pressing the mounting laterally without play against a selected one of rail head sides 26, 33 of the associated rail. Illustrated drive means 11 consists of two hydraulically operated cylinder-piston motors having respective ends linked to machine frame 2 and the mounting. Machine 1 is preferably self-propelled, running on two undercarriages 3, 3, which are shown as double-axled swivel trucks, wherebetween mountings 9 and 10 are arranged, each mounting being linked to frame 2 by connecting rod 12 for moving the mounting with the machine. Machine frame 2 has couplings 8, 8 at respective ends thereof to enable the same to be incorporated into a train for movement between working sites over long distances.

The mounting has guide roller means for vertically and laterally guiding the mounting along the rail head of the associated rail. The guide roller means includes a plurality of guide rollers 13, i.e. six such rollers in the illustrated embodiment, for engaging the running surface of rail head 32 and for vertically guiding the mounting therealong without play, the mounting being under the load of motors 11. Guide rollers 13 are spaced along the mounting in the operating direction and are cylindrical. At least some of the guide rollers are removable or retractable so that the vertical support base of the mounting on the associated rail may be adapted to changing operating conditions by changing the number of guide rollers 13 engaging the running surface of the rail head. In this way, the arrangement may be adapted to removing short or long undulations or overflow metal, or to profiling the rail head. The guide roller means further includes an additional guide roller laterally guiding the mounting without play along a selected side 26, 33 of the rail head, which will be described hereinafter.

Rail contouring tool head 14 including downwardly projecting tool holder 15 is mounted on mounting 9, 10 between two guide rollers 13, 13, and rail contouring tool 16 is mounted in the tool holder (see FIGS. 7 and 8). Tool head 14 is vertically and laterally displaceable with respect to the mounting for adjustment of the tool in relation to the rail head.

Figure 2:
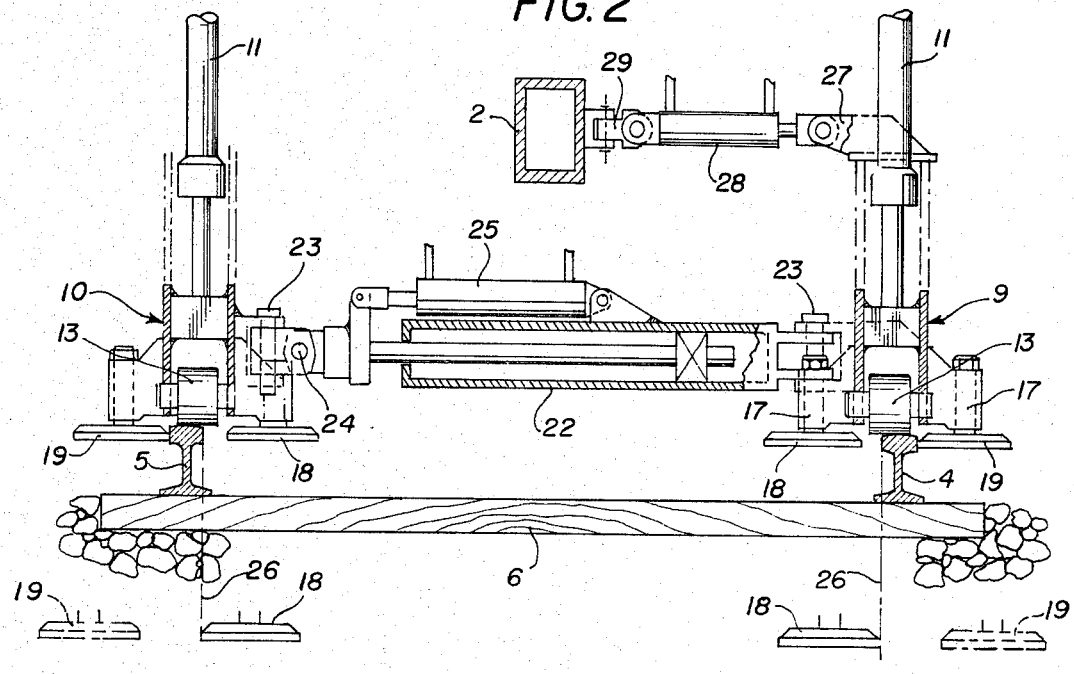
FIG. 2 is an enlarged transverse section along line II—II of FIG. 1.
Figure 3:
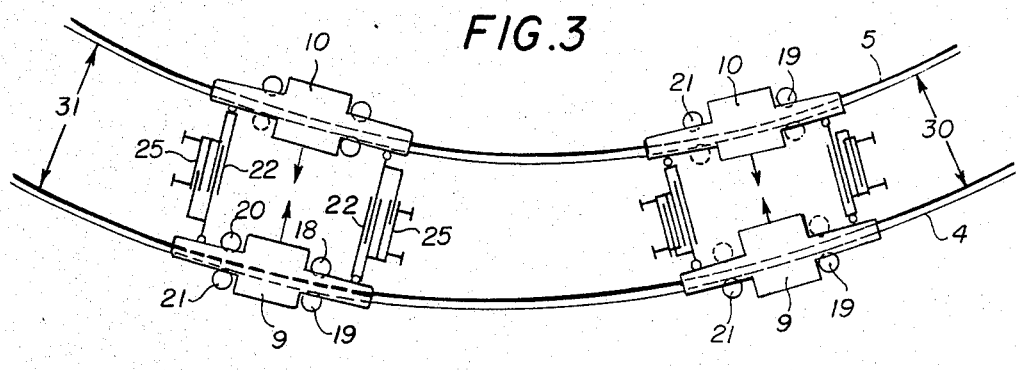
FIG. 3 is a schematic top plan view of the tool arrangement of the machine in two operating phases during work in a track curve.

FIG. 2 illustrates one embodiment of the arrangement of the additional guide roller laterally guiding the mounting without play along the side of the rail head which is not worn, i.e. the rail head side opposite to the one against which the rail contouring tool is applied. The illustrated arrangement comprises a pair of additional guide rollers 18, 19 operable for selectively guiding respective mounting 9, 10 along the selected side 26, 33 of rail head 32. As shown, each additional guide roller has an axis of rotation extending substantially parallel to the selected side of the rail head. The pair of additional guide rollers is arranged in the region of one of guide rollers 13 nearest tool head 14. Transversely extending bracket 17 mounts the pair of additional guide rollers 18, 19 in a fixed position on the mounting and the additional guide rollers of the pair are transversely aligned, one of the additional guide rollers 18 being arranged along the gage side and the other additional guide roller 19 being arranged along the field side. The additional guide rollers are disc-shaped and have a relatively narrow peripheral surface for laterally engaging a relatively narrow band of the selected side of the rail head, preferably the lowest region of the selected rail head side, as best shown in FIGS. 7 and 8. As illustrated in FIG. 3, a like pair of additional guide rollers 20, 21 is arranged in the region of the other guide roller 13 nearest tool head 14.

The arrangement of the axes of the additional guide rollers substantially parallel to the side of the rail head assures a solid engagement of their peripheral surfaces with the selected rail head side and, furthermore, prevents wear of the peripheral surfaces as they glide substantially friction-free along the rail head side. With a pair of additional guide rollers holding the rail head therebetween, excellent results are obtained with rail contouring tools arranged symmetrically with respect to a vertical center plane passing through the rail head since this arrangement automatically centers the mounting and the tool. The relatively narrow peripheral surface of the additional guide rollers laterally engaging a relatively narrow band of the rail head side makes it possible to provide exact lateral guidance of the mounting even with additional guide rollers of relatively small diameter.

In the embodiment illustrated in FIG. 2, a respective mounting 9, 10 is associated with each rail 4, 5 and respective pairs of additional guide rollers 18, 19 is operable for selectively guiding each mounting along the selected side of rail head 32 of each rail. A double-acting drive 25 acts on the mountings and is operatively connected to the additional guide rollers for engaging the additional guide rollers with the sides of the rails. In the illustrated embodiment, respective additional guide rollers 18 or 19 simultaneously engage respective sides 26 or 33 of the rail heads of both rails. Drive 25 is shown as hydraulically operated cylinder-piston motor. Such a drive is particularly simple and may be used for all types of rail contouring work on one or both rails.

The illustrated drive for laterally pressing the additional guide rollers against the selected sides of the rail heads comprises longitudinally adjustable spacing member 22 having respective ends linked to the mountings for continuously adjusting the transverse distance between the mountings to the gage of track 7. The preferred adjustable spacing member shown herein is comprised of two telescopingly engaged elements respectively linked to the mountings, one of the elements being a cylinder and the other element being a piston. As shown, a vertically extending pivot 23 links each end of spacing member 22 to a respective mounting 9, 10 and an additional horizontally extending pivot 24 links one of the spacing member ends to one of the mountings to provide a universal joint for this one spacing member end.

As indicated in FIG. 3, two such spacing members and drives are arranged between mountings 9 and 10, the universal joints being provided at diametrically opposite ends of the two spacing members so that the two mountings will always remain in parallel, extending in planes substantially perpendicular to the plane of the track while being guided exactly along the rails in a vertical and horizontal direction. Drive 25 is linked at respective ends to a respective element of the spacing member for adjustment thereof. In the position shown in FIG. 2, drive 25 has been operated to act to press mountings 9 and 10 towards each other so that additional guide rollers 19, 19 engage field sides 33 of rail heads 32 of rails 4 and 5 simultaneously, thus guiding the mountings without play along both rails. This position is selected for working along gage side 26 of one or both rails. The reverse operation of drive 25 is indicated schematically at the bottom of FIG. 2, the drive being operated to act to press the mountings apart so that additional guide rollers 18, 18 engage gage sides 26 of the rail heads for working along field sides 33 of one or both rails. Additional guide rollers 18, 19 of each pair define therebetween a transverse gap exceeding in width the width of rail head 32, the width of the transverse gap being preferably about twice the width of the rail head, and mounting 9, 10 bridges over the rail head and carries the additional guide rollers on brackets 17 with the rail being positioned therebetween.

This illustrated structure has the advantage of providing a very rigid arrangement providing a solid vise for the rail contouring tools and enabling this vise to be selectively guided along the field or gage sides of the rails for work on both rails, if desired, but also making it possible to work only along one of the rails. In a machine equipped with a single mounting for work on only one rail, one of the drive ends is linked to the mounting while the other drive end is linked directly to the machine frame.

FIG. 3 schematically illustrates the work of a unit consisting of two mountings 9 and 10 interconnected by spacing members 22 with drives 25 in a superelevated track curve whose track gage 31 has been increased in the transition curve from regular track gage 30, as is normal. In the transition curve, the mountings are laterally guided along rails 4 and 5 by additional guide rollers 19 and 21 which have been brought into engagement with the field sides of the rails by operation of drives 25 in the direction of the arrows. In view of the above-described linkage of the spacing members to the mountings, they will independently of each other follow the course of the rails with which they are associated while additional guide rollers 19, 21 remain in constant engagement with the field sides of the rail heads.

According to a preferred feature of this invention and as shown in FIGS. 2 and 4, the machine comprises a centering means for aligning mountings 9 and 10 with associated rails 4 and 5. The centering means comprises drive 28 generating a substantially horizontal driving force and having one end linked to one of the mountings and an opposite end linked to frame 2. In the illustrated embodiment, the drive is a substantially horizontally extending cylinder-piston motor, the piston being linked to mounting 9 and the cylinder being linked to frame 2. In the embodiment of FIG. 2, universal joint 29 links the cylinder end to the machine frame while mounting 9 has an upwardly projecting bracket 27 to which the piston end is linked. This centering means considerably facilitates the installation of the rail contouring arrangement before the work begins. It avoids any accidental damage to the guide rollers or other structural parts when the mountings are lowered onto the rails.

The embodiment of FIG. 4 is quite similar to that of FIG. 2 but, instead of mounting brackets 17 for additional guide rollers 18, 19, mountings 9 and 10 are themselves shaped as channel members bridging over rails 4 and 5. The two downwardly extending legs of the mountings at respective sides of the rails carry the additional guide rollers while guide rollers 13 are journaled between the two legs of the mountings. Such mountings have great rigidity and can carry additional guide rollers 18 to 21 of relatively small diameter. Such a rigid structure provides in effect a moving vise that holds the rail head in a rigid position against the hydraulically applied force of the rail configurating operation and is capable of absorbing very high work forces practically without deformation.

FIG. 5 shows a further embodiment of this invention wherein additional guide rollers 18, 19 and 20, 21 of each pair may be simultaneously engaged with field side 33 and gage side 26 of rail head 32 while guide rollers 13 engage the running surface of the rail head. For this purpose, double-acting hydraulic cylinder-piston drive 34 is connected to the additional guide rollers of each pair, bracket 37 carrying one of the additional rollers being affixed to, or integral with, the cylinder of drive 34 while bracket 38 carrying the other additional guide roller of the pair is affixed to, or integral with, the piston of the drive. When hydraulic pressure is applied to cylinder chamber 35 through conduit 36, the additional guide rollers of each pair are pressed towards each other, as indicated by the arrows, for simultaneously engaging the field and gage sides of the rail head whereby mounting 10 is exactly centered over rail 5. When hydraulic pressure is applied to the other cylinder chamber through the conduit leading thereinto, the two additional guide rollers of the pair are moved apart.

To enable the additional guide rollers to be readily replaced, they are detachably mounted in brackets 37 and 38. For this purpose, the upper ends of the shafts of the additional rollers, which are rotatably journaled in the brackets, define annular grooves 39 and the roller shafts are held in the brackets by pins 40 engaging the annular grooves and threadedly mounted in the brackets.

In the embodiment of FIG. 6, respective drives 42 are mounted on the mounting and are respectively connected to a respective additional guide roller 18, 19 (and 20, 21) for engaging the respective additional guide roller with the side of rail head 32 along which it is arranged, the additional guide roller 18, 20 being arranged along gage side 26 and the other additional guide rollers 19, 21 of each pair being arranged along field side 33 of rail head 32. This enables the additional guide rollers of each pair to be engaged simultaneously or sequentially with the associated side of the rail head while again assuring centering of the mounting in relation to the rail.

In the illustrated embodiment, transversely extending carrier 41 is shown affixed to mounting 10, i.e. by being welded thereto, and this carrier has at its respective ends double-acting hydraulic cylinder-piston drives 42. Carrier 41 straddles rail 5 which is centered in relation thereto and mounting 10 defines bushing 44 extending horizontally and transversely to the mounting and the rail. The bushing glidably receives the piston rods of pistons 43 of drives 42 and these pistons are reciprocated in cylinder chambers 47 defined at the ends of carrier 41. The piston rods define axially extending grooves 45 which are engaged by springs (not shown) to prevent rotation of the piston rods in bushing 44. Each piston rod has a bracket 46 intermediate the ends thereof and the additional guide rollers are journaled in these brackets. When hydraulic pressure is applied to outer cylinder chambers 47, the additional guide rollers of each pair are pressed together in the direction of the arrows to engage both sides of the rail head and to guide mounting 10 without play and properly centered along rail 5. Obviously, it is also possible to operate only one drive 42 so as to engage only one rail head side.

Tool head 14 including tool holder 15 is displaceably mounted on each mounting and a respective additional guide roller 18, 19 and 20, 21 is associated with each of the two guide rollers 13 between which the tool head is centrally mounted, as shown in FIG. 1. This arrangement, which may include two more guide rollers 13 spaced from each of the guide rollers at either side of the tool head, as illustrated in FIG. 1, is particularly effective for guiding the mounting during removal of running surface undulations or ripples of different wavelengths. With this arrangement and the fixed positioning of the additional guide rollers on the mounting, it is not only possible to adjust the tool according to the desired profile of the rail head to be restored but also to engage and disengage the tool at the beginning and at the end of the work without having to move the mounting.

The rail contouring tool used in the machine of the invention may be a grinding tool, such as a whetstone, but FIGS. 7 and 8 show preferred embodiments according to which rail contouring tool 16 carries a cutting blade having a cutting edge for planing a selected profile of rail head 32. The embodiment of FIG. 7 is designed for machining overflow metal 48 off field side 33 of the rail head. Tool 16 detachably carries cutting blade 52 having cutting edge 53 whereby the tool is enabled to carry cutting blades with different cutting edges. In the illustrated embodiment, tool holder 15 defines a dove-tailed recess 50 extending in the operating direction, i.e. parallel to the rail, and receiving tool part 49 of rail contouring tool 16, the tool part being securely retained in dove-tailed recess 50 by clamping plate 51. Cutting blade 52 is detachably held in tool 16 by wedge 55 and clamping shoes 56, being rigidly held in a position wherein cutting edge 53 encloses an acute angle, for example 45°, with plane 54 extending parallel to the plane of the track. The rectilinear cutting edge engages overflow 48 and removes it in a continuous chip or shaving during the continuous movement of machine 1 along the track. To provide lateral guidance and a counter-support for the cutting blade, additional guide rollers 18, 20 laterally guides the mounting without play along gage side 26 opposite field side 33 facing rail contouring tool 16.

As shown in broken lines in the upper left-hand corner of FIG. 7, overflow metal 48 may be removed by another type of rail contouring tool, cutting blade 52 being replaced, for example, by rotary grinding disc 57.

With such a tool arrangement, different types of tools may be rapidly substituted while the mounting remains centered with respect to the rail, only the displacement of the tool head being required for this purpose.

In the embodiment of FIG. 8, a cutting blade arrangement for restoring the original profile of one half of rail head 32, including gage side 26 and the adjacent portion of running surface 58, is provided. For this purpose, cutting blade 59 has a cutting edge conforming to the desired profile and is held in tool 16 by clamping shoes 60. Additional guide roller 19, 21 engaged field side 33 of the rail head while cutting blade 59 machines the opposite side thereof. As shown in the upper righthand corner of FIG. 8 in broken lines, in this embodiment, too, cutting blade 59 may be replaced by a suitably shaped whetstone 61 to produce the desired rail head configuration.

Those skilled in the art will appreciate that the present invention is not limited to the specific embodiments herein described and illustrated. Thus, the lateral guide rollers may have vertical axes extending not parallel to the vertical center plane of the rail head but at an acute angle thereto. Their peripheral surfaces engaging the sides of the rail heads may take any desired configuration, including cylindrical, conical or differently curvilinear. The number of guide rollers may also differ from that shown and may be increased, for instance, for added adjustability of the reference basis and for providing an even stronger vise capable of absorbing very high working forces and being selectively guided along one or the other side of the rail head. Furthermore, the various guides and drives for the tool head in horizontal and vertical direction may take any suitable form for displaceably mounting the tool head on the mounting. Similarly, the structure of the tool holder and the detachably mounting of the tool in the holder may take any suitable form.

What is claimed is:

1. A mobile rail contouring machine mounted on a railroad track for continuous movement in an operating direction, the track including two rails each having a rail head defining a gage side, a field side and a running surface, the gage and field sides extending from the running surface to a lower edge of the rail head, the machine being arranged for continuously removing such running surface irregularities as ripples, corrugations and overflow metal during the continuous movement and comprising (a) a frame running on the track on undercarriages having flanged wheels engaging the gage and field sides in a zone adjacent the running surface, (b) a respective rail contouring tool mounting linked to the frame and associated with each rail, (c) drive means for adjusting each mounting vertically relative to the running surface of the rail head of the associated rails and for pressing the mounting thereagainst, (d) additional drive means for laterally pressing each mounting independently of the other mounting and without play against a selected one of the rail head sides of the associated rail, (e) guide roller means for vertically and laterally guiding each mounting along said rail head, the guide roller means including (1) a plurality of guide rollers engaging the running surface of said rail head and vertically guiding the mounting therealong, the guide rollers being spaced along the mounting in the operating direction and being stationary with respect to the mounting during the continuous movement, and (2) an additional guide roller laterally guiding the mounting without play along a selected one of the sides of said rail head and engaging the selected rail head side in a region extending from the lower edge to below the zone adjacent the running surface, (f) a rail contouring tool head including a tool holder mounted on each mounting between two of the plurality of guide rollers, and (g) a rail contouring tool mounted in the tool holder.

2. The mobile rail contouring machine of claim 1, wherein the additional guide roller has an axis of rotation extending substantially parallel to the selected side of said rail head.

3. The mobile rail contouring machine of claim 2, comprising a pair of said additional guide rollers operable for selectively guiding the mounting along the selected side of the rail head.

4. The mobile rail contouring machine of claim 1, wherein the tool head including the tool holder is displaceably mounted on the mounting, a respective one of the additional guide rollers is associated with each one of the two guide rollers, and the tool head is mounted centrally between the two guide rollers and their associated additional guide rollers.

5. The mobile rail contouring machine of claim 1, wherein the additional guide roller has a relatively narrow peripheral surface for laterally engaging a relatively narrow band of the selected side of the rail head side.

6. The mobile rail contouring machine of claim 1, wherein a respective one of the additional guide rollers is associated with each one of the two guide rollers, the additional guide rollers being mounted on the mounting in a fixed position, and the tool head is substantially centrally mounted on the mounting between the additional guide rollers, the tool head including the tool holder being displaceable with respect to the mounting.

7. The mobile rail contouring machine of claim 6, wherein the rail contouring tool carries a cutting blade having a cutting edge for planing a selected profile of the rail head.

8. The mobile rail contouring machine of claim 7, wherein the tool head is vertically and laterally displaceable with respect to the mounting and the tool detachably carries the cutting blade whereby the tool is enabled to carry cutting blades with different cutting edges.

9. The mobile rail contouring machine of claim 1, wherein the selected side of the rail head along which the additional guide roller laterally guides the mounting without play is opposite the side of the rail head facing the rail contouring tool.

10. A mobile rail contouring machine mounted on a railroad track for continuous movement in an operating direction, the track including two rails each having a rail head defining a gage side, a field side and a running surface, the gage and field sides extending from the running surface to a lower edge of the rail head, the machine being arranged for continuously removing such running surface irregularities as ripples, corrugations and overflow metal during the continuous movement and comprising (a) a frame running on the track on undercarriages having flanged wheels engaging the gage and field sides in a zone adjacent the running surface, (b) a respective rail contouring tool mounting linked to the frame and associated with each rail, (c) drive means for adjusting each mounting vertically relative to the running surface of the rail head of the associated rail and for pressing the mounting thereagainst and laterally without play against a selected one of the rail head sides of the associated rail, (d) guide roller means for vertically and laterally guiding each mounting along said rail head, the guide roller means including (1) a plurality of guide rollers engaging the running surface of said rail head and vertically guiding the mounting therealong, the guide rollers being spaced along the mounting in the operating direction and being stationary with respect to the mounting during the continuous movement, and (2) a pair of transversely aligned additional guide rollers for laterally guiding the mounting without play along a selected one of the sides of said rail head and engaging the selected rail head side in a region extending from the lower edge to below the zone adjacent the running surface, one of the additional guide rollers being arranged along the gage side and the other additional guide roller being arranged along the field side, (e) a double-acting drive acting on each mounting and operatively connected to the additional guide rollers for engaging the additional guide rollers with the sides of the rail head, (f) a rail contouring tool head including a tool holder mounted on each mounting between two of the plurality of guide rollers, and (g) a rail contouring tool mounted in the tool holder.

11. A mobile rail contouring machine mounted on a railroad track for continuous movement in an operating direction, the track including two rails each having a rail head defining a gage side, a field side and a running surface, the gage and field sides extending from the runningsurface to a lower edge of the rail head, the machine being arranged for continuously removing such running surface irregularities as ripples, corrugations and overflow metal during the continuous movement and comprising (a) a frame running on the track on undercarriages having flanged wheels engaging the gage and field sides in a zone adjacent the running surface, (b) a respective rail contouring tool mounting linked to the frame and associated with each rail, (c) drive means for adjusting each mounting vertically relative to the running surface of the rail head of the associated rail and for pressing the mounting thereagainst and laterally without play against a selected one of the rail head sides of the associated rail, (d) guide roller means for vertically and laterally guiding each mounting along said rail head, the guide roller means including (1) a plurality of guide rollers engaging the running surface of said rail head and vertically guiding the mounting therealong, the guide rollers being spaced along the mounting in the operating direction and being stationary with respect to the mounting during the continuous movement, and (2) a pair of additional guide rollers for laterally guiding the mounting without play along a selected one of the sides of said rail head and engaging the selected rail head side in a region extending from the lower edge to below the zone adjacent the running surface, one of the additional guide rollers being arranged along the gage side and the other additional guide roller being arranged along the field side, (e) respective drives mounted on each mounting and respectively connected to a respective ones of the additional guide rollers for engaging the respective additional guide roller with the side of the rail head along which it is arranged, (f) a rail contouring tool head including a tool holder mounted on each mounting between two of the plurality of guide rollers, and (g) a rail contouring tool mounted in the tool holder.

12. A mobile rail contouring machine mounted on a railroad track for continuous movement in an operating direction, the track including two rails each having a rail head defining a gage side, a field side and a running surface, the gage and field sides extending from the running surface to a lower edge of the rail head, the machine being arranged for continuously removing such running surface irregularities as ripples, corrugations and overflow metal during the continuous movement and comprising (a) a frame running on the track on undercarriages having flanged wheels engaging the gage and field sides in a zone adjacent the running surface, (b) a respective rail contouring tool mounting linked to the frame and associated with each rail, (c) drive means for adjusting each mounting vertically relative to the running surface of the rail head of the associated rail and for pressing the mounting thereagainst and laterally without play against a selected one of the rail head sides of the associated rail, (d) guide roller means for vertically and laterally guiding each mounting along said rail head, the guide roller means including (1) a plurality of guide rollers engaging the running surface of said rail head and vertically guiding the mounting therealong, the guide rollers being spaced along the mounting in the operating direction and being stationary with respect to the mounting during the continuous movement, and (2) a pair of transversely aligned additional guide rollers laterally guiding the mounting without play along a selected one of the sides of said rail head and engaging the selected rail head side in a region extending from the lower edge to below the zone adjacent the running surface, the additional guide rollers of the pair defining therebetween a transverse gap exceeding the width of the rail head, the mounting bridging over the rail head and carrying the additional guide rollers with the rail head being positioned therebetween, (e) a drive for selectively engaging a respective one of the additional guide rollers with the selected side of the rail head, (f) a rail contouring tool head including a tool holder mounted on each mounting between two of the plurality of guide rollers, and (g) a rail contouring tool mounted in the tool holder.

13. The mobile rail contouring machine of claim 12, wherein the width of the transverse gap is about twice the width of the rail head.

14. The mobile rail contouring machine of claim 12, wherein a respective one of the pairs of said additional guide rollers is operable for selectively guiding each mounting along the selected side of the rail head of each rail, and further comprising a drive linked to the mountings for simultaneously and selectively engaging respective ones of the additional guide rollers of each pair with the selected sides of the rail heads.

15. The mobile rail contouring machine of claim 14, wherein the drive is double-acting.

16. The mobile rail contouring machine of claim 15, wherein the adjustable spacing member is comprised of two telescopingly engaged elements respectively linked to the mountings, one of the elements being a cylinder and the other element being a piston.

17. The mobile rail contouring machine of claim 14, wherein the drive comprises a longitudinally adjustable spacing member having respective ends linked to the mountings for continuously adjusting the transverse distance between the mountings to the track gage.

18. The mobile rail contouring machine of claim 14, further comprising a centering means for aligning the mountings with the associated rails, the centering means comprising a drive generating a substantially horizontal driving force and having one end linked to one of the mountings and an opposite end linked to the frame.

19. The mobile rail contouring machine of claim 18, wherein the drive is a substantially horizontally extending cylinder-piston motor, the piston being linked to the one mounting and the cylinder being linked to the frame.

* * * * *